US010638238B1

(12) United States Patent
Kienzle

(10) Patent No.: US 10,638,238 B1
(45) Date of Patent: Apr. 28, 2020

(54) CACOPHONY REDUCTION IN DIRECTIONAL SOUND RECEIVERS

(71) Applicant: John A Kienzle, Shawnee, OK (US)

(72) Inventor: John A Kienzle, Shawnee, OK (US)

( * ) Notice: Subject to any disclaimer, the term of this patent is extended or adjusted under 35 U.S.C. 154(b) by 0 days.

(21) Appl. No.: 16/431,048

(22) Filed: Jun. 4, 2019

(51) Int. Cl.
*H04R 5/033* (2006.01)
*H04R 1/34* (2006.01)
*H04R 25/00* (2006.01)

(52) U.S. Cl.
CPC ..... *H04R 25/402* (2013.01); *H04R 1/345* (2013.01); *H04R 5/033* (2013.01); *H04R 5/0335* (2013.01)

(58) Field of Classification Search
CPC ..... H04R 1/345; H04R 1/30; H04R 1/342; H04R 1/326; H04R 1/222; H04R 25/402; H04R 9/048; H04R 2499/11; H04R 1/14; G10K 11/26; G10K 11/08; G10K 11/22; G10K 11/02; G10K 11/28; G10K 11/025
See application file for complete search history.

(56) References Cited

U.S. PATENT DOCUMENTS 2,577,288 A 12/1951 Terlinde
2,882,348 A 4/1959 Erickson
3,240,883 A 3/1966 Seeler
3,617,654 A 11/1971 Heidrich
3,766,333 A 10/1973 Watson
4,250,499 A 2/1981 Kienzle
4,401,859 A 8/1983 Watson
4,410,770 A 10/1983 Hagey
4,449,236 A 5/1984 Walker, Jr.
4,694,499 A 9/1987 Bartlett
5,282,245 A * 1/1994 Anderson ..... H04M 1/19 379/433.03
6,899,633 B1 5/2005 Kienzle
D548,729 S 8/2007 Miller
8,351,633 B2 * 1/2013 Lassally ..... H04R 1/086 381/359
9,014,402 B2 4/2015 Terpstra et al.
(Continued)

FOREIGN PATENT DOCUMENTS

CN 2619431 Y 6/2004
WO 2008139269 11/2008

OTHER PUBLICATIONS

Axis Communications; "C3003-E Netowrk Horn Speaker", 2016-2017.

(Continued)

*Primary Examiner* — Sunita Joshi
(74) *Attorney, Agent, or Firm* — Robert H. Frantz

(57) ABSTRACT

A listening assistive device comprising with a sound-condensing collector structure having an open air end to receive non-cacophonic sound energy from a user-selected direction, a tapered guide through which the sound energy is condensed to a distal end at which a microphone converts the condensed sound energy to an electronic signal. A first interface of sound energy attenuating material (absorption, conversion, and/or reflection) is disposed around one or more outer surfaces of the collector structure, optionally around a handle, and a second interface sound energy attenuating material (absorption, conversion, and/or reflection) is disposed between the microphone and the collector structure, so as to attenuate cacophonic sounds from being received by the microphone.

17 Claims, 4 Drawing Sheets

(56) References Cited

U.S. PATENT DOCUMENTS

| | | | | |
|---|---|---|---|---|
| 2012/0257777 | A1* | 10/2012 | Tanaka | H04R 19/04 381/355 |
| 2018/0359562 | A1 | 12/2018 | Skramstad et al. | |

OTHER PUBLICATIONS

Blackwell, Dale B.; SUper Directional Microphone, Radio Electronics, Jul. 1990; retrieved from www.n5dux.com/ham/files/pdf/Super%20Directional%20Microphone.pdf on Apr. 12, 2019.
Dornfield, et al.; "An Acoustic Lens-Horn for Signal Enhancement in Acoustic Quality Assurance"; Annals of the CIRP, vol. 30/1/1981, pp. 317.
Louroe Electronics; "TLO Outdoor Speaker/Microphone" Technical Data Sheet.
Pettersson; "D500x Microphone Directional Horn", retrieved on Apr. 12, 2019 from https://bamanagement.com.
Souster, Iner; "The Funnel Mic", retrieved on Apr. 12, 2019 from http://inersouster.blogspot.com.
TalkTech.com; "Stenomask / Steno SR"; retrieved on Apr. 12, 2019 from https://talktech.com.

* cited by examiner

CACOPHONY REDUCTION IN DIRECTIONAL SOUND RECEIVERS

FIELD OF THE INVENTION

The invention generally relates technologies to selectively collect and amplify sound signals to assist and improve hearing.

BACKGROUND OF INVENTION

Cacophony is a mixture of sounds which are typically unrelated, and thus can create a confusing blend to many listeners. Noise, which generally is unwanted or undesired information, often is more random in nature and maybe easier to ignore or distinguish from desired audible signals. Cacophony, for the purposes of this disclosure, will refer to audible signals which represent real information, such as natural sounds (birds, wind, water flowing, etc.), man-made sounds (blower motors, vehicles, lighting hum, etc.), voices, music, alerts, tones, beeps, etc., mixed together, arriving from a plurality of directions relative to the listener, often with one or more sources of echo.

SUMMARY OF THE EXEMPLARY

Embodiment(s) of the Invention

A listening assistive device is disclosed which incorporates an ear trumpet directional receiver, or a parabolic directional receiver, or a combination of these receivers. The directional receiver sound collector structure has an open air end to receive non-cacophonic sound energy from a user-selected direction, a tapered guide through which the sound energy is directed towards a microphone that converts the condensed sound energy to an electronic signal, and includes a first interface on an outer wall of the device where sound energy attenuating material (absorption, conversion, and/or reflection) is disposed around one or more outer surfaces of the collector structure, and includes a second interface surrounding a microphone with sound energy attenuating material (absorption, conversion, and/or reflection) between the microphone and the collector's substantially rigid structure, so as to attenuate cacophonic sounds from being received by the microphone.

DETAILED DESCRIPTION OF ONE OR MORE EMBODIMENTS OF THE INVENTION

Figure 1:
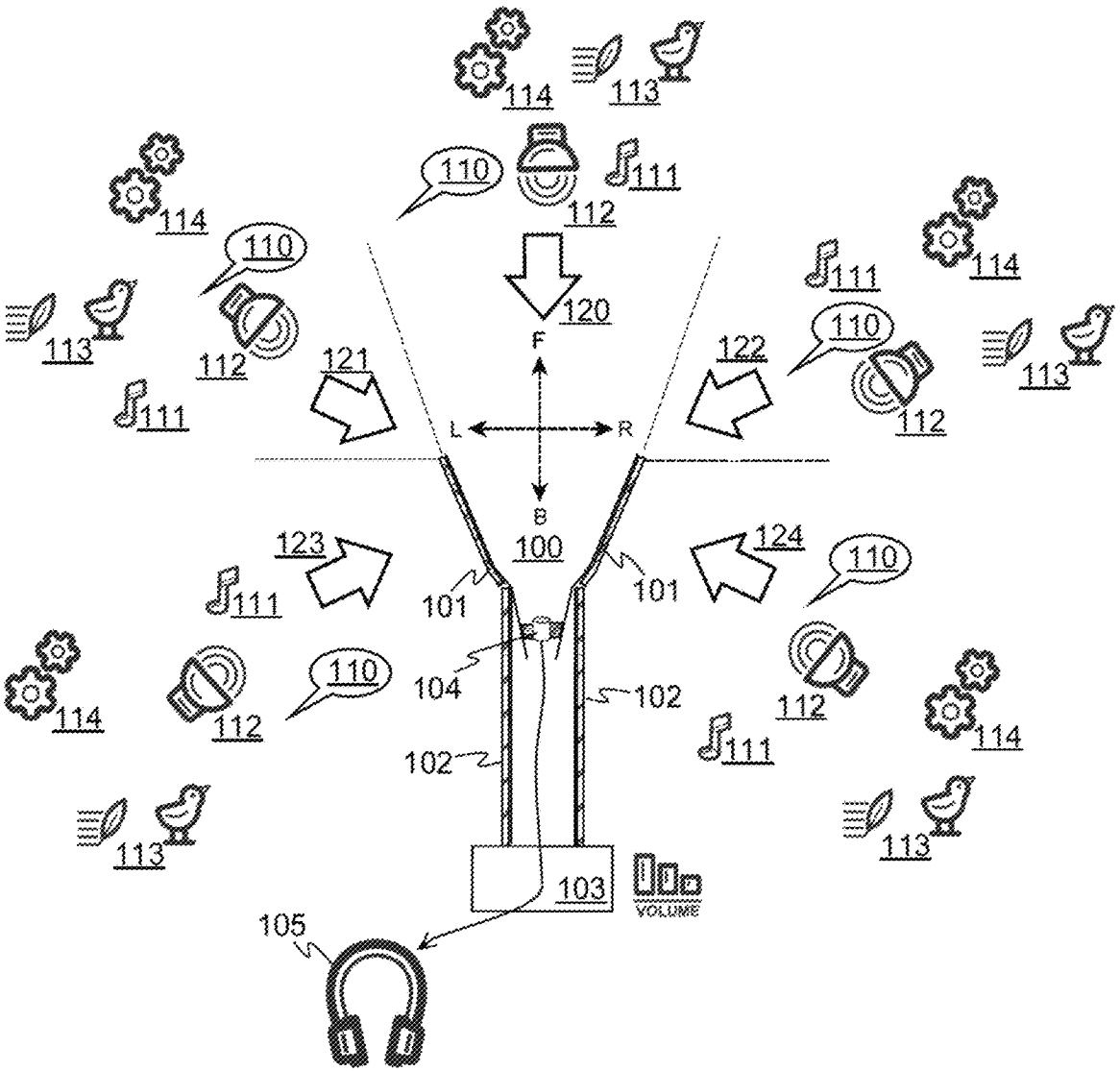
FIG. 1 illustrates a cut-away view of a directional listening device according to at least one embodiment of the present invention, including ambient context relative to collected and rejected sound signals.

The inventor of the present invention has recognized a problem in the art not previously recognized or addressed regarding assistive devices for selecting, and optionally amplifying, certain sound sources in the presence of cacophony. In particular, the present inventor has discovered and recognized shortcomings in the presently-available manners, devices and systems to address signal isolation from cacophony.

Passive ear trumpets perform mechanical concentration of sound energy from a distance into a physical concavity or hollow structure, through a progressively narrowing passageway, until the concentrated sound energy is allowed to exit into an ear canal of a user. Parabolic reflector receivers associated with electronic microphones provide phase alignment via physical transmission path differences or electronic phase delay elements to achieve constructive interferences of some inbound signals and destructive interference of other signals. However, these devices each have certain shortcomings, such as providing too much signal isolation wherein the net signal presented to the user is unnaturally narrow (similar to optical tunnel vision).

Further, the present inventor realized that these mechanical structures often received signal impending on the device from undesired directions because those signals created mechanical vibrations on the external surfaces of the systems which were transmitted to the listening device and/or ear, and often amplified as cacophony mixed with the desired non-cacophony signals.

Embodiments of the present invention comprise one or more directional sound receivers employing a physical hollow concavity type with one or more electronic microphones and electronic amplifiers. In at least one embodiment, a single directional sound receiver alters the regions of its interfaces through which unwanted cacophony type ambient sound must pass to enter the electronic microphone using sound deadening materials between those interfaces to absorb cacophony type signals and unwanted ambient sounds prior to their reaching the microphone through those interfaces.

For purposes of this disclosure, the term "interface" will be used to indicate and describe boundary regions of differing material density, or between two separate parts that need mounting connection. These interfaces are such regions as between air and solids, and the term "sound deadening material" will be used to indicate and describe a variety of materials surface treatments which are relatively non-conductive of sound.

Because output from amplified microphone signal contains both desired (non-cacophony) sound and undesired (cacophony) sound, there is a need two address sound interface locations through which such undesired cacophony sounds enters the microphone. In a directional system, unwanted sound may arrive from somewhere other than the desired direction, such as ambient or stray sound which enters the microphone via side walls of the device, as opposed to the desired sounds which enters the system through a mechanical or acoustic collection structure. The one or more embodiments of the present invention improve clarity of desired sound while rendering it more pleasant by reducing unwanted cacophony sound from reaching the microphone of the device by providing improvements to the reduction of such collection of sound through the non-directional interfaces. The regions of such interfaces are the only regions that allow sound deadening means to be easily utilized to help with cacophony problems reaching their microphones and thus improving the function of the device.

Looking at this problem, the present inventor considered baffles for sound absorption or deflection to help keep unwanted ambient sound from entering the open air largest concavity opening of such hollow devices, but found due to large baffle size this was not practical. That left unwanted ambient sound that was first reaching the outer sidewalls to enter the device the remaining option. The present inventor realized that little could be done with solid sidewalls other than where those sidewalls externally interface outer air or touch.

In studying early prototype devices, the present inventor found two primary interfaces where sound deadening materials could be readily and effectively applied. Unwanted ambient sound crossing interfaces needed an available means to use in order to keep unwanted ambient sound from reaching a well oriented but supported microphone housing that was mounted by sound deadening means to the solid or rigid interconnected parts of the device. Using the order of the entry of unwanted cacophony type ambient sound through the outer wall of the device, the present inventor named two entry interfaces to microphone as the first entry point interface being the external device region to the outer wall of the device as the first interface, and the housing of the microphone to the solid construction of the device as being the second interface.

Usually there are two types of unwanted sound that enter at the first interface, where one type is from anything moving and touching the outer wall producing sound vibrations and the other from the outer air of the device to the solid structure of its outer wall where much more distant but also unwanted sound sources are located.

For purposes of the present disclosure, the term "side walls" will refer to any externally air or touch facing contiguous parts of the device's various solid parts that are parts of the same solid material or parts that are rigidly fixed together by gluing or other means, to be made rigid or solid, that are facing sound sources external to the device.

Other internal parts and surfaces within its air opening concavity are not considered outer sidewalls, which the present inventor refers to as the device's internal sidewalls. There is a need to reduce such undesired sound energy from coming through those two interfaces from outer sidewalls and reaching the microphones of such devices coming originally from unwanted sound directions reaching the device's outer sidewalls. This is because wanted sound is only coming from a sound source that the device is pointed at, and then contacts its inner sidewalls of the device, to be listened to, and that come from a desired sound source and such as a pointed at sound that is not included as a side wall unwanted type of ambient sound. Some unwanted sound still may still enter via the largest air opening of this directional sound receiver device, however, unwanted sounds at which the system is not pointed are substantially reduced.

Embodiments of the present invention include one or more types of acoustic-mechanical directional sound receivers, and one or more mounted electronic microphones and audio amplifiers for listening purposes. One such directional sound receiver type is a parabolic sound receiver, and another type is an ear trumpet sound receiver. Both have air filled concavities that allow directional sound to first come from a distant sound source to their large open air end of their concavity. The directional sound then enters that opening in an axial manner that is approximately parallel to the axial line from the source of sound to the center of that cavity's largest transverse area air opening. Their method of operation after the distant sound reaches and enters the concavity is different.

The parabolic sound receiver then relies on the shape of the walls of the concavity to reflect sound energy that entered the largest air opening and is reflected by the shape of the inner walls to a focus located usually inside the largest air opening area of the hollow parabolic shaped concavity.

However, the ear trumpet receiver relies on a different principle by using energy conservation to taper or streamline the moving sound energy so in effect an amount of sound energy enters the largest air opening area of its concavity over some common time interval to convert power to the largest opening area a common energy moving toward a smaller area. Then that sound energy from the large area is concentrated to a smaller cross sectional area and thus by conservation of energy the sound energy per unit area in the small cross sectional area over the same given interval of time, is greater per unit area, with greater instantaneous sound amplitude for sound detecting objects located within that smaller area, such as microphones or ear drums. In this directional sound receiving method, where the transmitted energy loss is lower if the walls are smooth and streamlined, it allows more sound energy per unit cross sectional area at the small end of the tapered smaller concavity, and the sound energy is thus more concentrated per unit area where the time interval for that amount of energy is considered the same at both opening area and cross sectional tapered area to the microphone.

So, for ear trumpets, rather than using the other parabolic reflection method of focusing sound to the microphone, have energy concentration that happens where any energy loss due to internal sound energy absorption with conversion to heat energy and is small due to streamlining. The mounted microphone according to the present invention is thus positioned distal to the sound entering the larger area and is situated near the region of greatest sound concentration (at the smallest end).

That concentration of energy in the ear trumpet method to a smaller area, was first utilized by the evolution of animals with external ear concavities called a pinna of the ear, that focuses the sound energy to a more concentrated distal and lesser area where sound energy per unit area is greater over some like unit of time. Animals such as some birds such as owls and many mammals such as bats have such external ears or pinnas, and many hear directional sound better than humans some even by using rotated pinnas to point in the direction of sound origin. Old photographs of Thomas Edison show him cupping his hand behind the pinna of his ear to enlarge the opening area that sound energy enters as he was partially deaf. He later invented such ear trumpets that were huge and several meters long, and it was reported a listener at the small end of his largest gigantic ear trumpet could listen there and understand a speaker over a mile away.

This energy concentration principle was mathematically described by a Swiss mathematician named Daniel Bernoulli, several years even before the 1802 lectures to the Royal Society in England where Thomas Young first used the word "energy" in its modern sense, that is still used today to describe this fairly efficient sound energy conservation from the large opening cross-sectional opening area of directional sound receivers using so called "streamlining" the sound to a smaller cross-sectional area deeper within the concavity where a listening device such as an ear drum or microphone might be placed. Bernoulli's equation explains why the smaller area concentrates the sound energy per unit of cross sectional area in the ear trumpet's smaller end.

Bernoulli's parameters are more easily understood today in newer physics to simply be a method of energy conservation where the cross sectional area tapers or streamlines to concentrate the moving sound energy to a smaller area. So the acoustic energy collection principles of both type directional sound receivers are well known to those having ordinary skill in the art. In this ear trumpet receiver such concentration of directional sound energy from a sound source, first coming to a large opening area, and then to a smaller area may no longer be axially directed, after the sound energy sound that is axially directed, enters the larger opening concavity end of the air opening, as it might be curved to the listening device in some ear trumpets. The inner walls of the concavity taper or streamline smoothly into a smaller area, resulting in more energy per unit of cross-sectional area (or volume) at the distal smaller end of the concavity.

Turning to FIG. 1, a cross-sectional view from above of a cacophonic-reducing listening device (100) according to the present invention is shown. This particular exemplary embodiment includes a trumpet-style collector, but those ordinarily skilled in the art will readily recognize that the following design features may be implemented with similar benefits to an embodiment having a parabolic collector.

Desired (non-cacophonic) sounds arrive from the front (120) of the funnel-shaped collection structure (101) to be discussed in more detail in the following paragraphs. This group of desired sounds may include a mixture of voice (110), amplified sound (112), music (11), man-made sounds (114) and natural sounds (113), which are condensed by the collection device prior to being received by a microphone (104) and amplified (103) for a listening device such as headphone (105).

Similar mixtures of sounds, albeit unwanted sounds, may impend on the device (100) from the left (123) and right (124), which are attenuated in manners to be described further in the following paragraphs. To provide for a more natural selection of the desired sounds from the front (120), the device also receives signals from side lobe regions adjacent to the front regions, such as from the front-left (121) and the front-right (122).

Sounds from these side lobe regions are partially received into the concave structure and condensed towards the microphone, and are partially attenuated. In this manner, the received and amplified signal presented to the listening device comprises the front received sounds as the greatest component, accompanied by a portion, but not all, of the side lobe-received sounds, absent the considerably attenuated side-received sounds. This produces a composite sound which does not resemble tunnel vision in the audible world, and which contains enough of the adjacent sounds to provide context to the listener of the desired (front zone) sounds.

Figure 2:
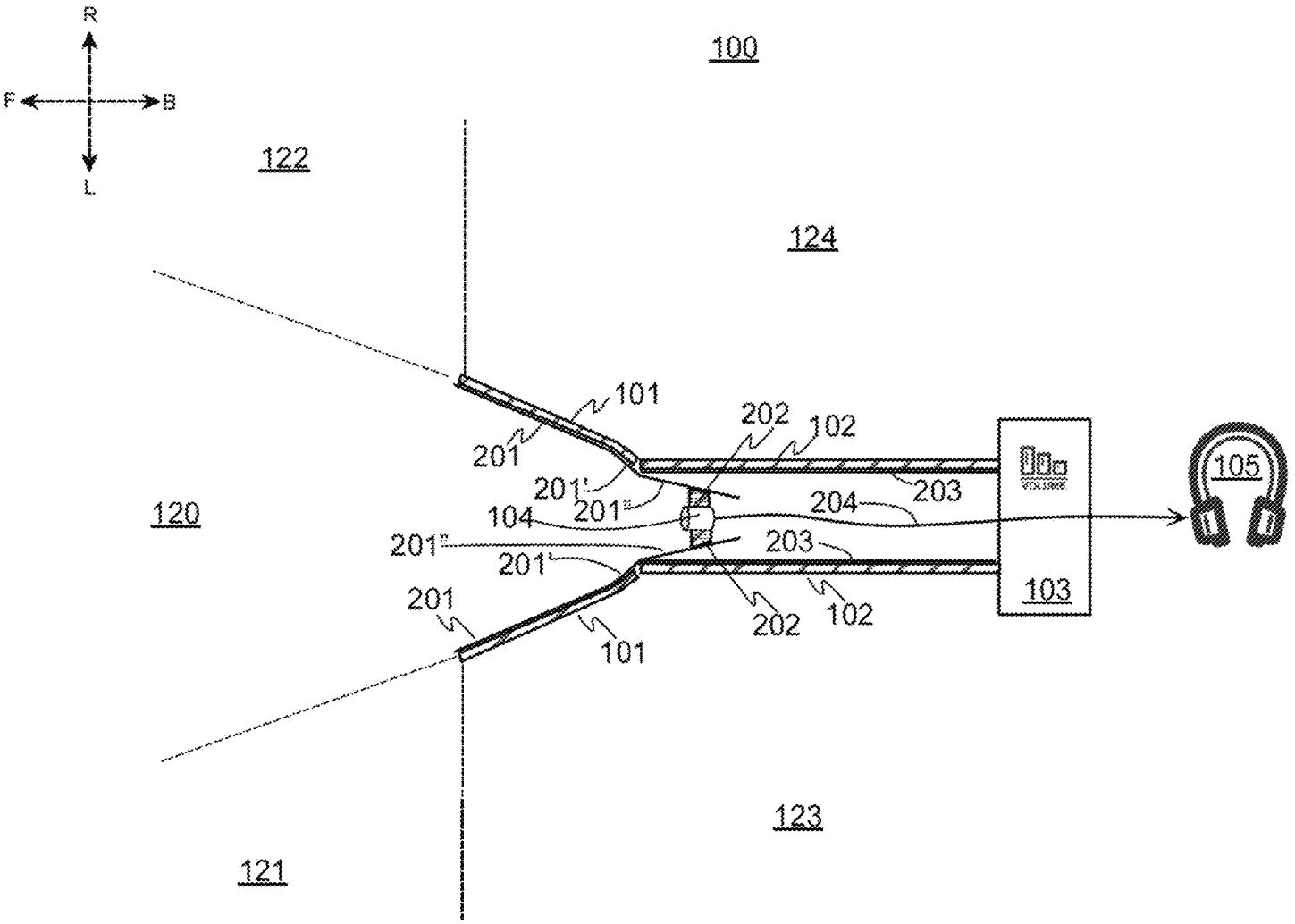
FIG. 2 provides greater details of the structures of the embodiment shown in FIG. 1

Referring now to FIG. 2, the front zone (120) of collection is shown relative to the concave collection walls (201, 201', and 201") which are generally acoustically reflective (non-absorptive). There may be one or more different sets of taper, such as the three sets of taper, shown in the collection structure to provide the ear trumpet type of condensing of audio energy as it is guided towards the microphone (104). In this embodiment, a rigid handle portion (203) is provided in the general shape of a tube, through which electronic connection of the microphone to an amplifier (103) is made.

To reduce the induction of unwanted sounds from the side regions (123, 124), one or more acoustically attenuating materials are disposed on the first interface on the outside of the collector walls (101) and on the outside of the handle (102). Sound which is received through the air or through the user's touching of the device is absorbed and attenuated at this first interface, preferably by a layer of open cell foam which has a textured or smoother outer surface, called in the open cell foam trade, as "skinned over the open cell underlying material. The texture not only provides for greater sound absorption due to increase surface area, it also enhances the grip for the user, resist weather, and reflects away some incident sound. Other materials, such as glass wool, cloth, vinyl, open cell polyurethane foam, paper, cardboard, etc., can be used for this first interface treatment in other embodiments. In some embodiments, a smooth-skinned open cell foam may be utilized, whereas the smooth skin provides reflection of a portion of the sound incident upon it. The sounds arriving at the device from the side lobes (121, 122) are partially received into the concavity defined by the acoustically-reflective walls (201, 201', 201"), and are partially attenuated by the outer absorptive layer (101).

Further, a second interface of sound attenuation to reduce collection and amplification of cacophony is provided around the microphone (104). In at least one embodiment, the microphone was mounted at the distal end of the collector using a ring (202) of sound absorptive open cell foam material, which can be of similar or different material than the material used on outside walls at the first interface.

Additionally, the microphone mounting and isolation can be a unitary component, such as a die-cut ring of foam material, or an injection molded open cell foam, or can be a plurality of portions, such as packed portions of open cell foam. This second interface (202) further reduces any signal which makes it through the first interface before it can reach the microphone and be included in the microphones output (204) to the amplifier (103).

Figure 3:
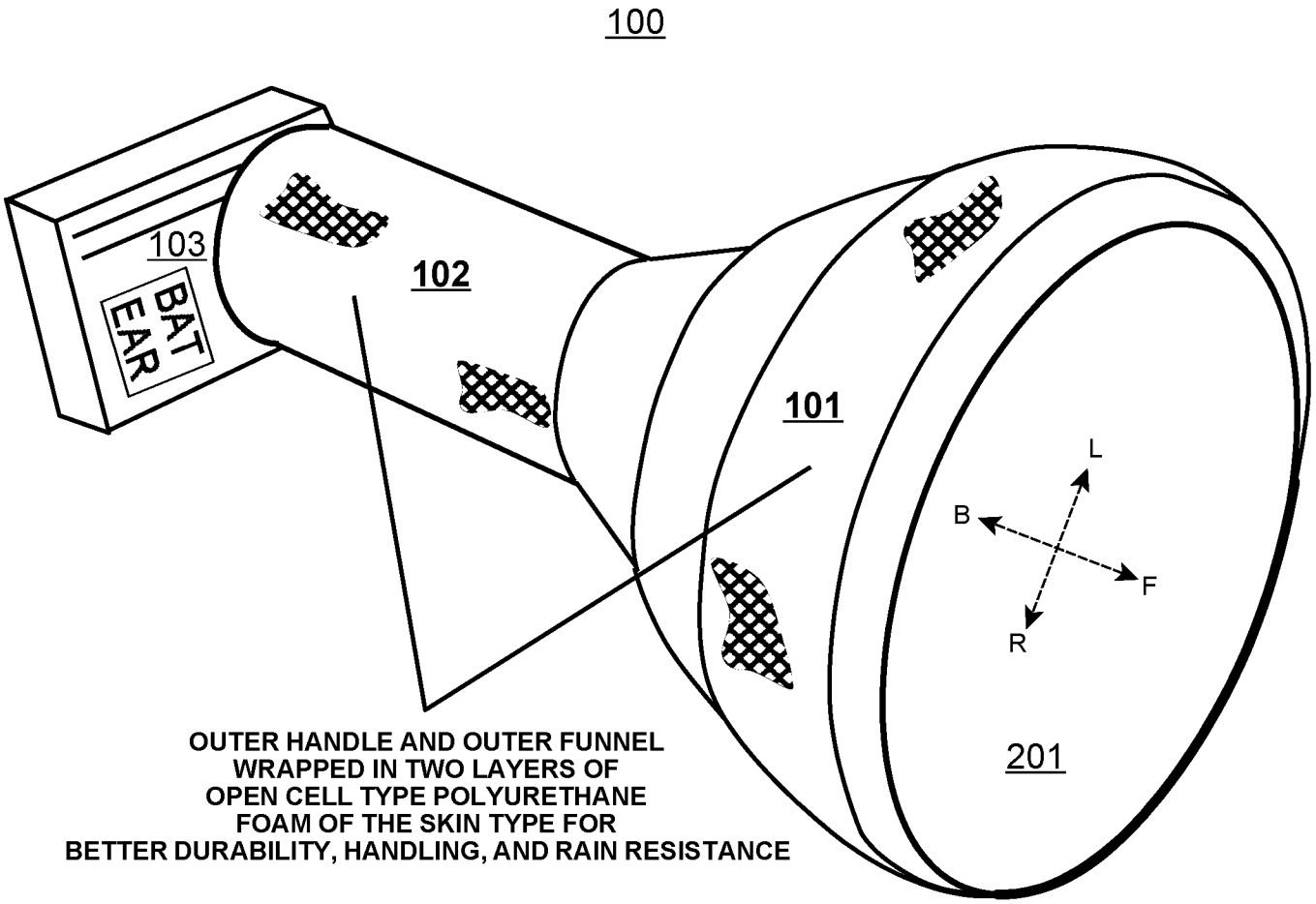
FIG. 3 shows an isometric view of an actual prototype according to the invention.

FIG. 3 provides an isometric view of an actual prototype, as described according to at least one embodiment in the foregoing paragraphs. The primary collection structure comprised a semi-rigid plastic funnel having a glossy or slick surface which reflected sound well. A microphone was mounted in the distal (smaller) end of the collector using a donut-shaped portion of sound foam. The collector was glued to a short portion of PVC pipe to form a handle, and a wire from the microphone was passed through the handle to an audio amplifier, which was mounted to the other end of the handle. Finally, a layer of textured open cell foam was cut and affixed to the outside surfaces of the handle and the collector.

Figure 4:
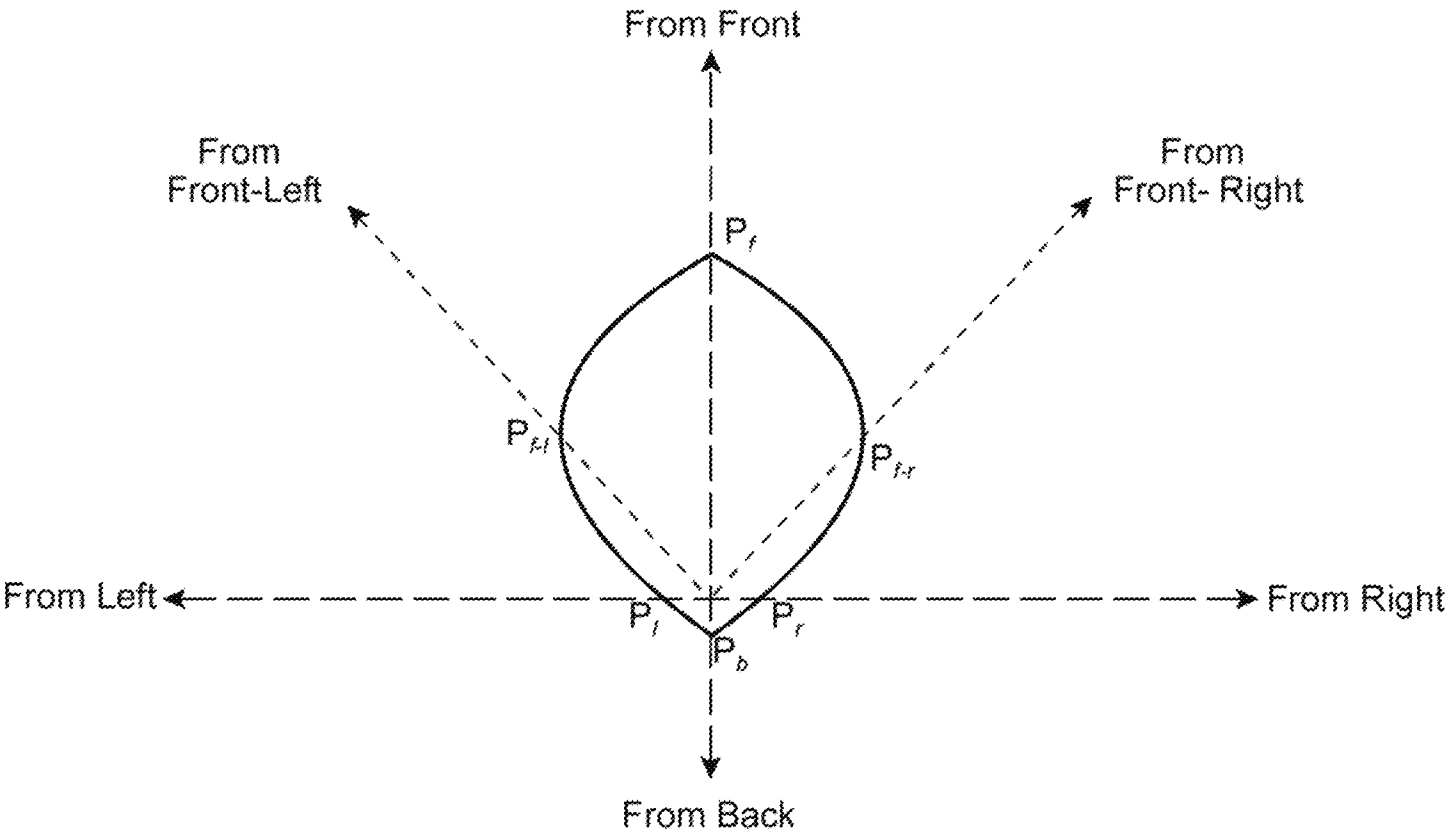
FIG. 4 depicts an exemplary gain plot which may be realized by at least one embodiment of the present invention.

In practice, the one or more embodiments will selectively collect, and optionally amplify, desired audio signals in the presence of directionally-oriented cacophony sounds. In FIG. 4, an exemplary polar gain plot is shown, in which the greatest gain $P_f$ for the selected non-cacophony signal is applied mechanically and electronically to the portion of the audio arriving from the front of the device into the concave collector structure. The greatest attenuation or least amount of gain $P_b$ is applied mechanically and electronically to the portion of the non-desired cacophony audio arriving from the back of the device. And, gain amounts $P_{f\text{-}l}$ and $P_{f\text{-}r}$ greater than the back gain $P_b$ but less than the front gain $P_f$ are applied mechanically and electronically to the portion of the contextual cacophony audio arriving from the side lobes of the device.

In some embodiments, the structures as described may be used in pairs in order to yield stereophonic sound collection, and each pair of devices may be attached to a pair of headphones, hat, helmet, or otherwise worn on the top or sides a user's head to allow for natural pointing of the collectors towards a desired source of sound the same direction looked at. In such a case, the first interface for reducing sound from a handle would serve as an interface to reduce sound induced by the mounting hardware for the head-worn embodiment such that head movement would not induce unwanted noise into the microphone(s).

Further, as those ordinarily skilled in the art will recognize, well-known noise reduction design practices may be utilized on certain embodiments to further enhance noise rejection and noise reduction. For example, a shielded conductor may be used to connect the microphone output to the amplifier, and internal electromagnetic shielding (paint, foil, etc.) may be designed into the audio amplifier to reduce electronic sources of unwanted noise.

CONCLUSION

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof, unless specifically stated otherwise.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

It will be readily recognized by those skilled in the art that the foregoing example embodiments do not define the extent or scope of the present invention, but instead are provided as illustrations of how to make and use at least one embodiment of the invention. The following claims define the extent and scope of at least one invention disclosed herein.

What is claimed is:

1. A listening assistive device comprising:

a sound receiver that has a hollow sound collector structure having a larger open air end into which non-cacophonic sound energy is received from a selected direction, a smaller guide portion inside the sound collector structure, defined by one or more smooth, substantially rigid walls from which the received sound energy is directed towards the smaller guide portion, wherein at least one dimension of the larger open air end is three centimeters or greater to receive a range of frequencies of sound energy perceptible by humans, and wherein the substantially rigid walls comprise a parabolic type or an ear trumpet type of structure;

a handle affixed to the collector structure;

a microphone disposed at a position relative to the sound receiver to receive sound from the smaller guide portion to convert the received sound energy to an electronic signal;

a first interface sound energy attenuating material disposed around at least an exterior portion of the substantially rigid walls, and further disposed around at least a portion of the handle to diminish sounds from a user touching and sounds incident upon the handle portion; and a second interface sound energy attenuating material disposed between a case of the microphone and an attachment region of the device's rigid structure, wherein the attachment region comprises a distal inner surface part of an ear trumpet type structure or a microphone support of a parabolic type structure.

2. The listening assistive device as set forth in claim 1 wherein the first interface sound energy attenuating material comprises an open cell foam material.

3. The listening assistive device as set forth in claim 1 wherein the first interface sound energy attenuating material comprises a textured material.

4. The listening assistive device as set forth in claim 1 wherein the first interface sound energy attenuating material comprises a material selected from the group consisting of glass wool, mineral wool, cotton, cloth, vinyl, closed cell foam, smooth skinned cell foam, paper, and cardboard.

5. The listening assistive device as set forth in claim 1 wherein the second interface sound energy attenuating material comprises an open cell foam material.

6. The listening assistive device as set forth in claim 1 wherein the second interface sound energy attenuating material comprises a material selected from the group consisting of closed open cell foam, rubber, glass wool, mineral wool, cotton, cloth, vinyl, smooth skinned cell foam, paper, and cardboard.

7. The listening assistive device as set forth in claim 1 further comprising an audioband amplifier receiving the electronic signal, and outputting an amplified signal suitable for a listening device.

8. The listening assistive device as set forth in claim 7 further comprising a listening device selected from the group consisting of a headphone, an ear bud, and a speaker.

9. The listening assistive device as set forth in claim 1 further comprising a mount portion affixed to the collector structure, and wherein the first interface sound energy attenuating material is further disposed around one or more outer surfaces of the mount portion.

10. The listening assistive device as set forth in claim 9 wherein the mount portion is configured to mount to one or more head-worn devices selected from the group consisting of a headband, a hat, a helmet, and a headphone.

11. The listening assistive device as set forth in claim 1 further comprising an electromagnetically shielded conductor for the electronic signal from the microphone, wherein the shielded conductor is electrically grounded to a ground connection of an audio-band amplifier.

12. The listening assistive device as set forth in claim 7 wherein the audio-band amplifier further comprises an electrically conductive electromagnetic grounding shield configured to reduce electronic noise induction into the audio-band amplifier.

13. The listening assistive device as set forth in claim 1 further comprising a second collector structure and a second microphone having the same structure of the first collector structure and the first microphone with the first interface sound energy attenuating material and second interface sound energy attenuating material, respectively, to yield a stereophonic listening assistive device.

14. The listening assistive device as set forth in claim 13 wherein the first and second collector structures are configured to be head worn.

15. The listening assistive device as set forth in claim 1 wherein the first interface sound energy attenuating material comprises a material to perform one or more sound attenuation functions selected from the group consisting of absorbing sound, reflecting sound, and converting sound to another form of energy.

16. The listening assistive device as set forth in claim 1 wherein the second interface sound energy attenuating material comprises a material to perform one or more sound attenuation functions selected from the group consisting of absorbing sound, reflecting sound, and converting sound to another form of energy.

17. The listening assistive device as set forth in claim 1 wherein the hollow sound collector structure is further configured to receive non-cacophonic sound energy is received from one or more side lobe regions adjacent to the selected direction.

* * * * *